US008121335B2

(12) United States Patent
Sharpe et al.

(10) Patent No.: US 8,121,335 B2
(45) Date of Patent: Feb. 21, 2012

(54) ACCENTUATED HEADWEAR

(76) Inventors: John F. Sharpe, Holiday, FL (US); David M. Sharpe, Clearwater, FL (US)

( * ) Notice: Subject to any disclaimer, the term of this patent is extended or adjusted under 35 U.S.C. 154(b) by 826 days.

(21) Appl. No.: 12/187,752

(22) Filed: Aug. 7, 2008

(65) Prior Publication Data

US 2010/0031424 A1 Feb. 11, 2010

(51) Int. Cl.
*H04R 25/00* (2006.01)

(52) U.S. Cl. ..... 381/376

(58) Field of Classification Search ..... 2/209.11, 2/209.12, 209.13, 410, 6.2; 381/374, 376
See application file for complete search history.

(56) References Cited

U.S. PATENT DOCUMENTS 4,525,878 A * 7/1985 Lowe, Jr. ..... 2/209.13
4,586,280 A 5/1986 Dane
D321,581 S * 11/1991 Li ..... D2/866
5,167,559 A * 12/1992 Power-Fardy ..... 446/27
5,410,746 A * 4/1995 Gelber ..... 455/344
5,438,698 A * 8/1995 Burton et al. ..... 455/351
5,462,471 A * 10/1995 Power-Fardy ..... 446/26
5,510,961 A * 4/1996 Peng ..... 362/106
5,680,718 A * 10/1997 Ratcliffe et al. ..... 40/329
6,007,212 A 12/1999 Chan
6,223,355 B1 5/2001 Irving
7,044,615 B2 * 5/2006 Gesten ..... 362/106
7,461,764 B2 * 12/2008 Thompson ..... 223/14
2006/0185062 A1 * 8/2006 Peng et al. ..... 2/209.13
2007/0226876 A1 * 10/2007 Foust et al. ..... 2/171
2008/0295224 A1 * 12/2008 Mintzer ..... 2/209.13
2009/0193565 A1 * 8/2009 Wilens ..... 2/209.13
2009/0241243 A1 * 10/2009 Ritter ..... 2/209.13
2010/0031424 A1 * 2/2010 Sharpe et al. ..... 2/209.11
2010/0313334 A1 * 12/2010 Moy ..... 2/209.13

* cited by examiner

*Primary Examiner* — Tuyen Nguyen
(74) *Attorney, Agent, or Firm* — Dale J. Ream

(57) ABSTRACT

An article of accentuated headwear includes an attire portion configured for attachment to a wearer's head. An electronic visual display and an audio output device are operatively coupled to the attire portion. The headwear includes an electronic memory. A processor is in data communication with the electronic visual display, the audio output device, and the electronic memory. The processor includes programming to actuate the electronic visual display and the audio output device. The headwear includes a user interface for controlling the processor. The headwear includes a power source for powering the processor, the electronic visual display, the audio output device, and the electronic memory.

20 Claims, 5 Drawing Sheets

ACCENTUATED HEADWEAR

BACKGROUND OF THE INVENTION

This invention relates generally to novelty headwear and, more particularly, to accentuated headwear for sports team apparel such as hats.

Sports apparel has been an expanding market for many years. Headwear such as baseball type caps is a popular means for sports fans to express their team loyalty. In fact, each sports team seems to have multiple styles and varieties of caps bearing their names, logos, or even likenesses of popular players. Some headwear seems to be designed to draw particular attention to the wearer or to the institution that it promotes. Headwear and other apparel often provides enhanced revenue production for the university or professional team.

Various devices have been proposed in the art for drawing attention to a hat, its wearer, or simply to vigorously promote a respective team. Although assumably effective for their intended purposes, these devices do not provide a multimedia experience or promotional presentation.

Therefore, it would be desirable to have accentuated headwear, such as a ball cap, having a visual display and audio output device attached thereto. Further, it would be desirable to have accentuated headwear having a processor and at least a picture or audio track stored therein for output by the display or audio output device. In addition, the accentuated headwear may include an array of LED's or other indicia associated with a respective institution or team for the purpose of promoting that institution or team.

SUMMARY OF THE INVENTION

Accordingly, an article of accentuated headwear according to the present invention includes an attire portion configured for attachment to a wearer's head. An electronic visual display and an audio output device are operatively coupled to the attire portion. The headwear includes an electronic memory. A processor is in data communication with the electronic visual display, the audio output device, and the electronic memory. The processor includes programming to actuate the electronic visual display and the audio output device. The headwear includes a user interface for controlling the processor. The headwear includes a power source for powering the processor, the electronic visual display, the audio output device, and the electronic memory.

Therefore, a general object of this invention is to provide an article of accentuated headwear for wear by a sports fan so as to promote a respective team, school, club, or institution.

Another object of this invention is to provide an article of accentuated headwear, as aforesaid, having visual and audio display devices capable of presenting pictures, video, and audio tracks, respectively, while the headwear is worn by a user.

Still another object of this invention is to provide an article of accentuated headwear, as aforesaid, having a USB interface such that audio and video files may be obtained by the headwear from a computer.

Yet another object of this invention is to provide an article of accentuated headwear, as aforesaid, that may be activated by a switch positioned under the bill of the cap.

A further object of this invention is to provide an article of accentuated headwear, as aforesaid, that is cost-effective to manufacture and user-friendly to use.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Articles of accentuated headwear will now be described in detail with reference to FIG. 1 through FIG. 5 of the accompanying drawings. More particularly, an article of accentuated headwear 100 includes an attire portion 110 configured for attachment to a wearer's head. The attire portion 110 may be a cap (as shown throughout the drawings), a visor, a cowboy hat, a stocking hat, a headband, or any other article of headwear, and may include static non-electric indicia 112.

Figure 1:
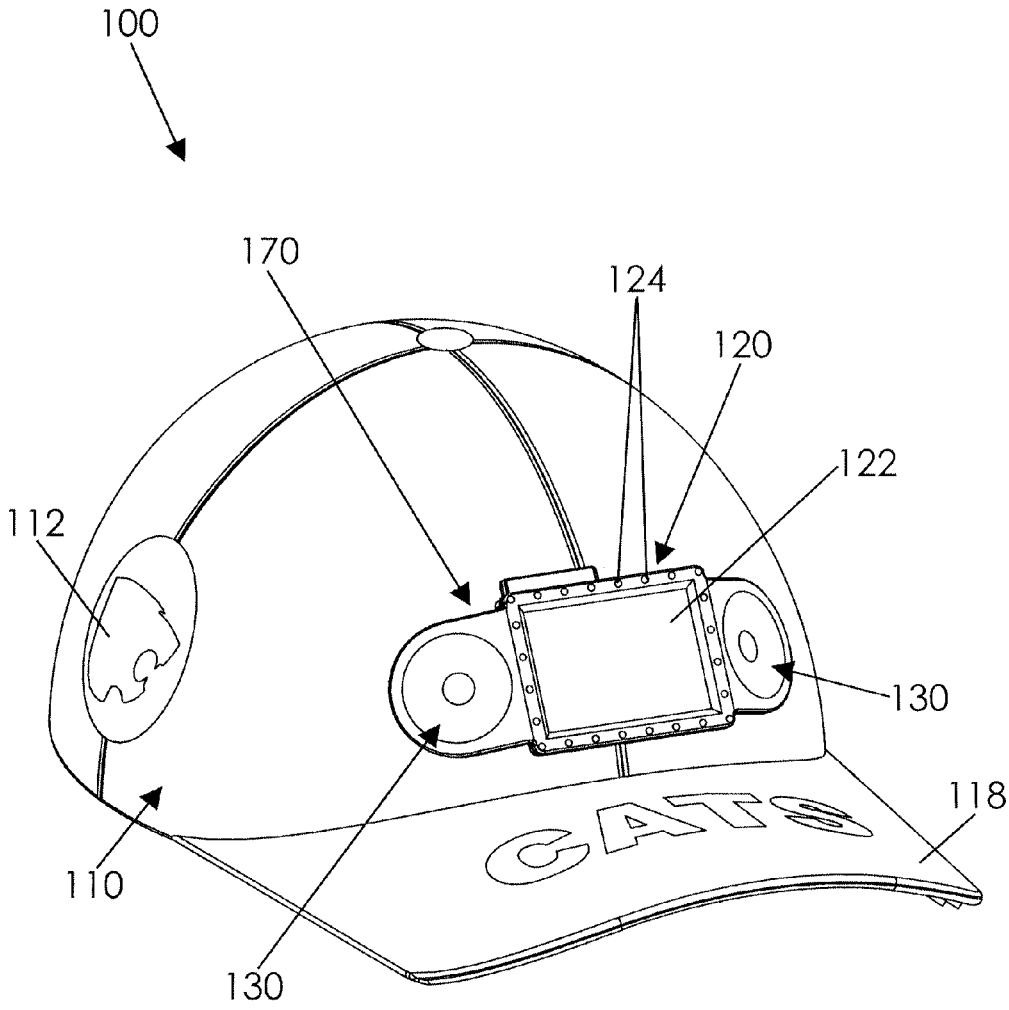
FIG. 1 is a perspective view of an article of accentuated headwear according to a preferred embodiment of the present invention.
Figure 2:
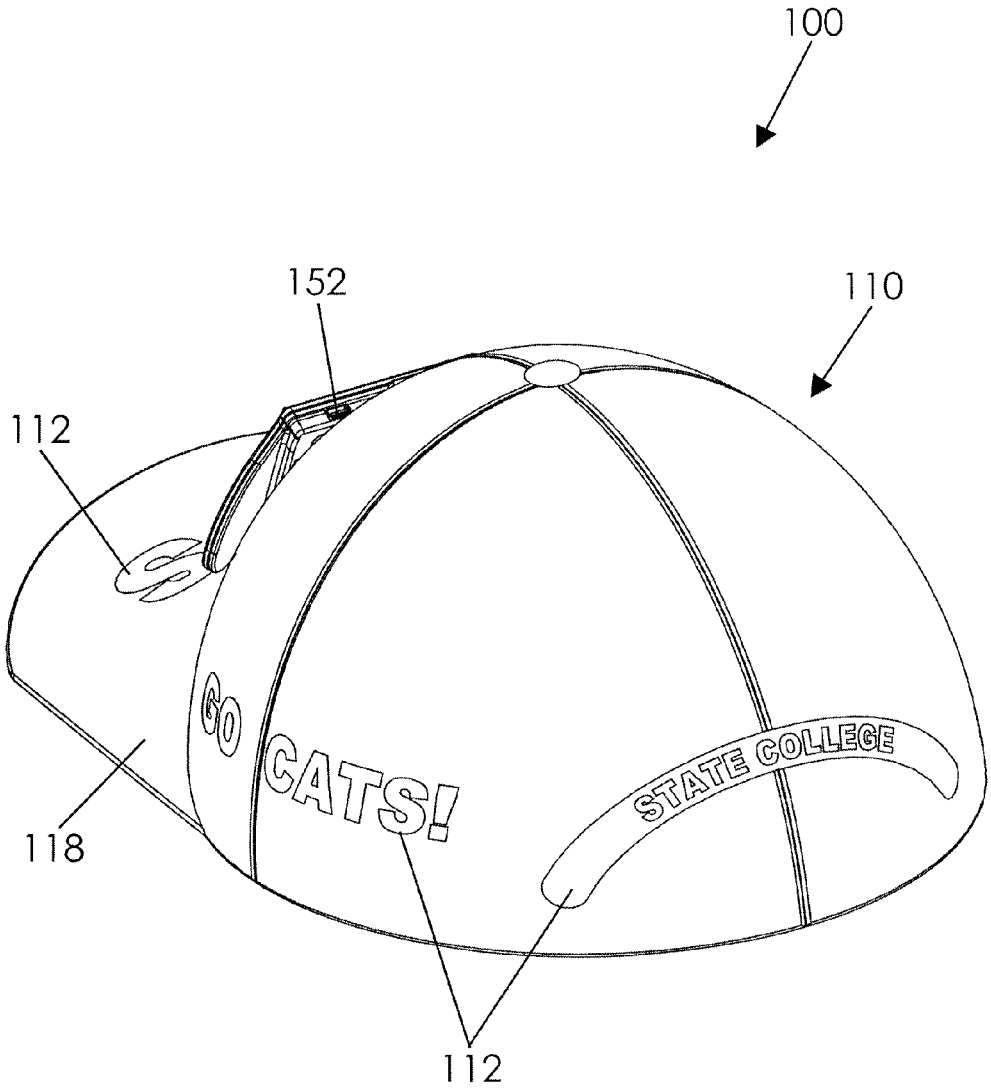
FIG. 2 is a perspective view of the headwear as in FIG. 1 taken from another angle.
Figure 5:
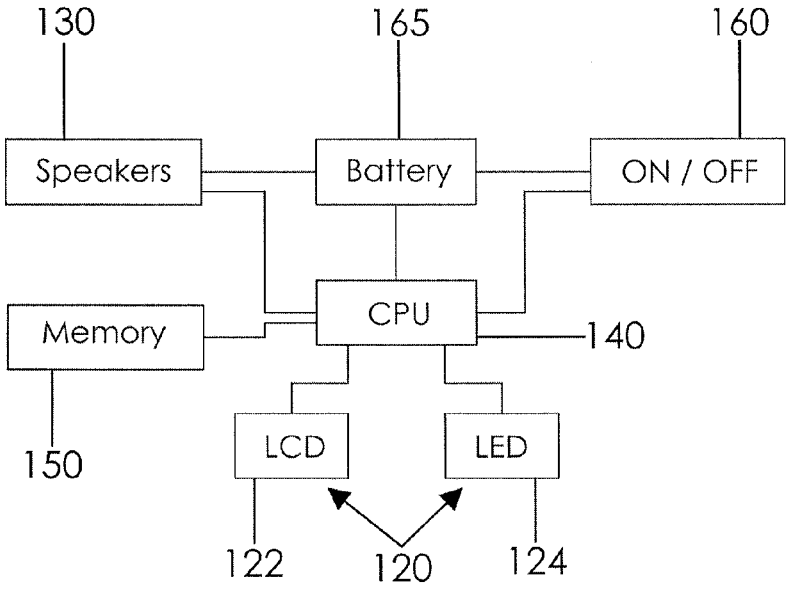
FIG. 5 is a block diagram of the electronic components of the present invention.

As shown in FIG. 1 and FIG. 5, an electronic visual display 120 is operatively coupled to the attire portion 110, and an audio output device 130 is operatively coupled to the attire portion 110. A processor 140 is in data communication with the electronic visual display 120, the audio output device 130, and electronic memory 150 (i.e., an electronic data storage device). The electronic memory 150 may include at least one picture (i.e., at least one still picture and/or at least one motion picture), audio track, and/or LED actuation pattern stored therein (i.e., electronically), and means may be included for changing the contents (e.g., pictures, audio tracks, LED actuation patterns) of the electronic memory 150. For example, the electronic memory 150 may be accessible through a data port 152 (FIGS. 2 and 4*b*), removable (denoted 154 in FIG. 4*b*), or otherwise altered by adding or removing data. It should be appreciated that multiple processors 140 and/or electronic memory devices 150 may optionally be used.

Figure 3:
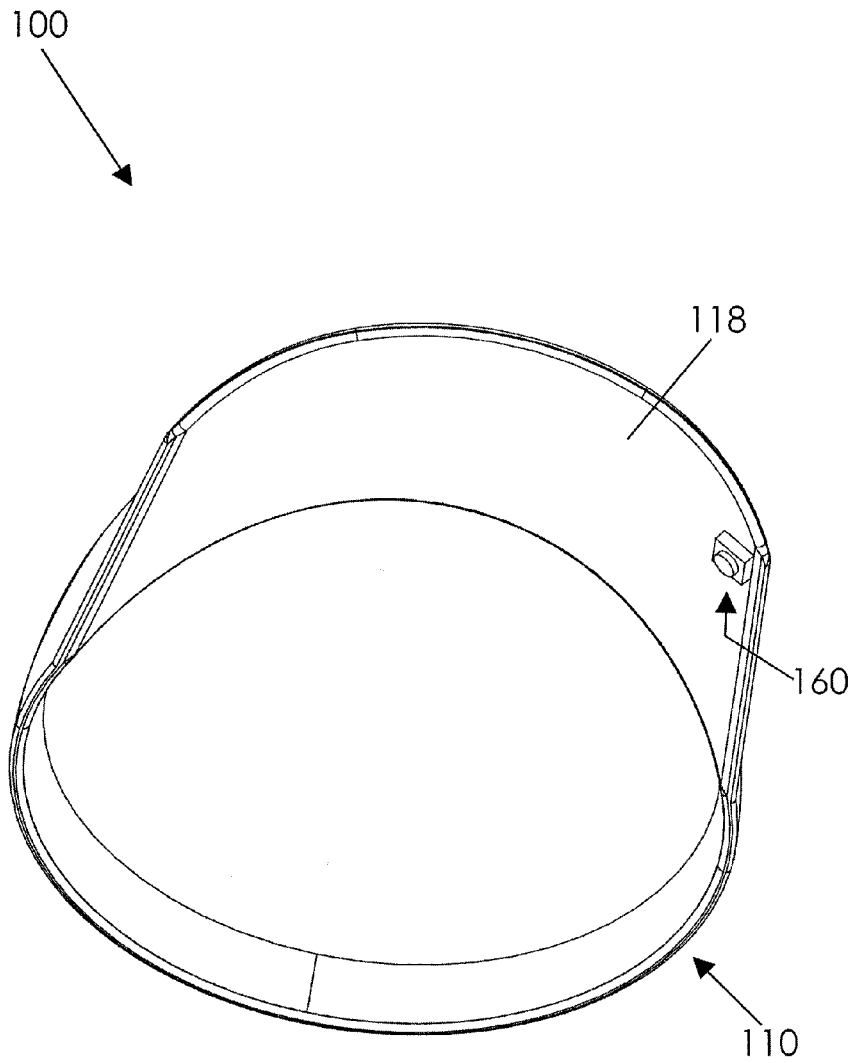
FIG. 3 is a perspective view of the headwear as in FIG. 1 taken from a bottom angle.
Figure 4A:
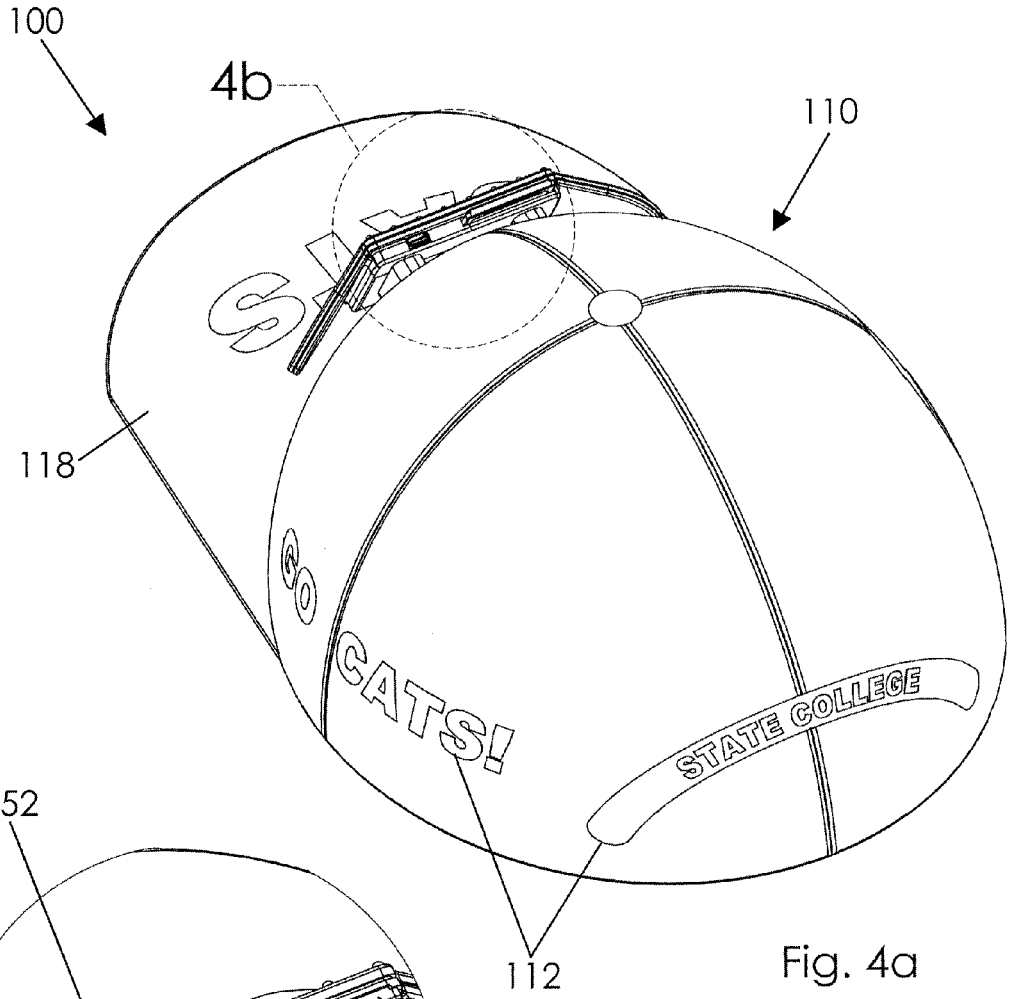
FIG. 4*a* is an elevated perspective view of the headwear as in FIG. 1.
Figure 4B:
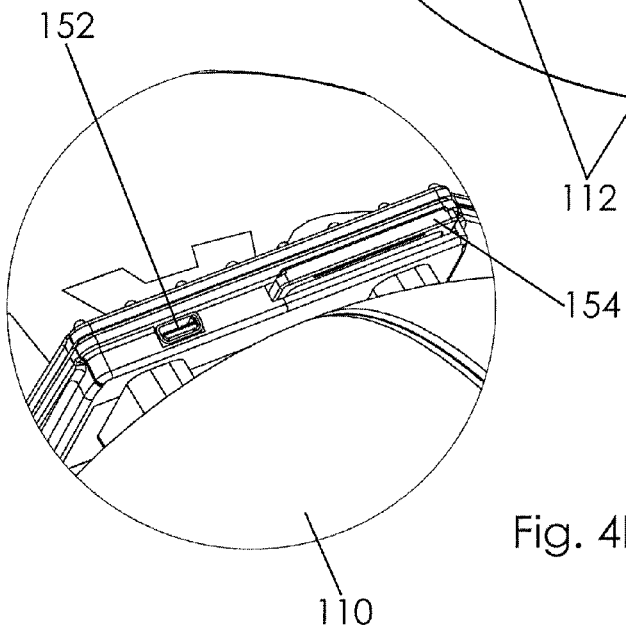
FIG. 4*b* is an isolated view on an enlarged scale of a portion of the headwear taken from FIG. 4*a*.

A user interface 160 (e.g., one or more button, switch, etc.) may be included for controlling the processor, and means for powering the electronic devices in the accentuated headwear 100 (e.g., electronic visual display 120, audio output device 130, processor 140, electronic memory 150) may be included. For example, one or more battery 165 (FIG. 5), solar panel, etc. may be in communication with the electronic devices. The user interface 160 may be operatively coupled to a bill 118 of the attire portion 110 (e.g., on an underside 118*a* of the bill 118, as shown in FIG. 3), or may otherwise be included in an accessible location.

The electronic visual display 120 may include an electronic display screen 122 (e.g., a LCD display, plasma display, etc.) for showing at least one picture (i.e., a still picture and/or a motion picture) and/or may include an array of LEDs 124, as shown in FIG. 1 and FIG. 5. The array of LEDs 124 may surround the electronic display screen 122 (FIG. 1), may surround static non-electronic indicia 112, or may be otherwise positioned. Programming in the processor 140 may cause the processor 140 to actuate the display screen 122 to show the one or more picture stored in the electronic memory 150 upon receiving input from the user interface 160. Additionally, or alternately, programming in the processor 140 may cause the processor 140 to actuate the LEDs 124 (e.g., in accordance with an LED actuation pattern stored in the electronic memory 150) upon receiving input from the user interface 160.

The audio output device 130 includes an electromechanical transducer that converts an electrical signal to sound. Acceptable output levels for the audio output device 130 may vary widely, and multiple audio output devices 130 may be included. Programming in the processor 140 may cause the processor 140 to actuate the audio output device 130 to perform, i.e. emit, the audio track(s) stored in the electronic memory 150 upon receiving input from the user interface 160.

A housing 170 (FIG. 1) may contain the electronic visual display 120 (i.e., the display screen 122 and/or the array of LEDs 124), the audio output device 130, the processor, and the electronic memory 150, and the housing 170 may be operatively coupled to the attire portion 110. Such a configuration may lower manufacturing costs when compared to directly (and separately) coupling the electronic visual display 120 and the audio output device 130 to the attire portion 110, for example.

In use, the accentuated headwear 100 may be customized for various applications. For example, for sports fans, the attire portion 110 may be a cap and the indicia 112 may be team indicia. The electronic memory 150 may include various pictures that are team related, such as venue pictures (i.e., still pictures and/or movies), personality (e.g., player, coach, etc.) pictures (i.e., still pictures and/or movies), mascot pictures (i.e., still pictures and/or movies), etc. Similarly, the electronic memory 150 may include various audio tracks that are team related, such as team fight songs, school songs, opponent taunts, etc. The LED actuation pattern(s) stored in the electronic memory 150 may cause the LEDs 124 to appear to rotate, blink, etc., and may correspond to one or more audio track. The contents of the electronic memory 150 may be changed as set forth above. The user may wear the attire portion 110 and may cause the processor 140 to actuate the display screen 122, the LEDs 124, and the audio output device 130 by using the user interface 160, as set forth above.

It is understood that while certain forms of this invention have been illustrated and described, it is not limited thereto except insofar as such limitations are included in the following claims and allowable functional equivalents thereof.

The invention claimed is:

1. An article of accentuated headwear, comprising:

an attire portion configured for attachment to a wearer's head;

an electronic visual display operatively coupled to said attire portion;

an audio output device operatively coupled to said attire portion;

electronic memory;

a processor in data communication with said electronic visual display, said audio output device, and said electronic memory; said processor including programming to actuate said electronic visual display and said audio output device;

a user interface for controlling said processor; and means for powering said processor, said electronic visual display, said audio output device, and said electronic memory.

2. The article of accentuated headwear of claim 1, wherein said electronic visual display includes a display for showing at least one of a still picture and a motion picture, said at least one of a still picture and a motion picture being stored in said electronic memory.

3. The article of accentuated headwear of claim 2, wherein said display for showing at least one of a still picture and a motion picture is at least one of a LCD display or a plasma display.

4. The article of accentuated headwear of claim 2, wherein said electronic visual display further includes an array of LEDs.

5. The article of accentuated headwear of claim 1, wherein said electronic visual display includes an array of LEDs.

6. The article of accentuated headwear of claim 1, further comprising a housing, and wherein:

said housing contains said electronic visual display, said audio output device, said electronic memory, and said processor; and said housing is operatively coupled to said attire portion.

7. The article of accentuated headwear of claim 6, wherein:

said attire portion includes a bill; and said user interface is operatively coupled to said bill.

8. The article of accentuated headwear of claim 1, wherein:

said electronic memory includes at least one picture stored therein;

said electronic visual display includes a screen for showing said at least one picture; and said electronic memory includes at least one audio track stored therein.

9. The article of accentuated headwear of claim 8, further comprising means for changing contents of said electronic memory.

10. The article of accentuated headwear of claim 9, further comprising a housing, and wherein:

said housing contains said electronic visual display, said audio output device, said electronic memory, and said processor;

said housing is operatively coupled to said attire portion;

said attire portion includes a bill;

said user interface is operatively coupled to said bill; and said electronic visual display further includes an array of LEDs.

11. The article of accentuated headwear of claim 10, wherein said attire portion includes static non-electronic indicia.

12. The article of accentuated headwear of claim 8, wherein:

said display for showing at least one picture is at least one of a LCD display or a plasma display; and said electronic visual display further includes an array of LEDs.

13. An article of accentuated headwear, comprising:

an attire portion configured for attachment to a wearer's head;

an audio output device operatively coupled to said attire portion;

an array of LEDs operatively coupled to said attire portion;

electronic memory containing at least one audio track;

a processor in data communication with said audio output device and said electronic memory to actuate said audio output device to emit said at least one audio track;

a user interface for controlling said processor;

means for powering said processor, said audio output device, said LEDs, and said electronic memory.

14. The article of accentuated headwear of claim 13, further comprising an electronic display screen for showing at least one picture, and wherein:

said electronic memory contains said at least one picture;

said processor is in data communication with said electronic display screen to actuate said electronic display screen to show said at least one picture.

15. The article of accentuated headwear of claim 14, wherein:

said attire portion includes static non-electronic indicia;

said array of LEDs surrounds at least one of said static non-electronic indicia and said electronic display screen;

said electronic memory contains at least one LED actuation pattern; and said processor is in data communication with said array of LEDs to actuate said LEDs in accordance with said at least one LED actuation pattern.

16. The article of accentuated headwear of claim 15, further comprising means for changing contents of said electronic memory.

17. The article of accentuated headwear of claim 16, further comprising a housing, and wherein:

said housing contains said array of LEDs, said audio output device, said electronic display screen, said electronic memory, and said processor;

said housing is operatively coupled to said attire portion;

said attire portion includes a bill; and said user interface is operatively coupled to said bill.

18. The article of accentuated headwear of claim 13, wherein:

said attire portion includes static non-electronic indicia;

said array of LEDs surrounds said static non-electronic indicia;

said electronic memory contains at least one LED actuation pattern; and said processor is in data communication with said array of LEDs to actuate said LEDs in accordance with said at least one LED actuation pattern.

19. An article of accentuated headwear, comprising:

an attire portion configured for attachment to a wearer's head;

an audio output device operatively coupled to said attire portion;

an electronic display screen operatively coupled to said attire portion for showing at least one picture;

electronic memory containing at least one audio track and said at least one picture;

a processor in data communication with said electronic memory and said audio output device to actuate said audio output device to perform said at least one audio track; said processor being in data communication with said electronic display screen to actuate said electronic display screen to show said at least one picture;

a user interface for controlling said processor; and means for powering said processor, said audio output device, said electronic display screen, and said electronic memory.

20. The article of accentuated headwear of claim 19, further comprising means for changing contents of said electronic memory.

* * * * *